US005542501A

United States Patent [19]

Ikejima et al.

[11] Patent Number: 5,542,501

[45] Date of Patent: Aug. 6, 1996

[54] APPARATUS FOR CONTROLLING AN ELEVATOR TO REDUCE VIBRATIONS CREATED IN A LINEAR DRIVE MOTOR

[75] Inventors: Hiroyuki Ikejima; Masanori Yasue, both of Inazawa, Japan

[73] Assignee: Mitsubishi Denki Kabushiki Kaisha, Tokyo, Japan

[21] Appl. No.: 344,631

[22] Filed: Nov. 17, 1994

Related U.S. Application Data

[63] Continuation-in-part of Ser. No. 988,848, Dec. 10, 1992, abandoned.

[30] Foreign Application Priority Data

Dec. 10, 1991 [JP] Japan ..... 3-326160

[51] Int. Cl.[6] ..... B66B 1/34

[52] U.S. Cl. ..... 187/292; 318/799; 318/801; 318/807; 187/293; 187/289

[58] Field of Search ..... 187/289, 292, 187/293, 296, 297; 318/799, 800, 801, 807, 811, 687; 388/843, 844, 930

[56] References Cited

U.S. PATENT DOCUMENTS

| | | | |
|---|---|---|---|
| 3,934,125 | 1/1976 | Macano | 235/150.2 |
| 4,061,089 | 12/1977 | Sawyer | 104/23 FS |
| 4,402,386 | 9/1983 | Ficheux et al. . | |
| 4,738,337 | 4/1988 | Caputo | 187/115 |
| 4,986,391 | 1/1991 | Salmon | 187/131 |
| 5,076,399 | 12/1991 | Horbruegger | 187/116 |
| 5,081,593 | 1/1992 | Pollack | 395/88 |

FOREIGN PATENT DOCUMENTS 1-271381 10/1989 Japan .

OTHER PUBLICATIONS

Patent Abstracts of Japan, 02–155405, Controller for Motor Diven Vehicle Aug. 31, 1990 Shiro Kurihara.

*Primary Examiner*—Robert Nappi
*Attorney, Agent, or Firm*—Leydig, Voit & Mayer

[57] ABSTRACT

An apparatus for controlling an elevator capable of providing enhanced comfort to passengers by reducing and compensating for propulsion change and propulsion ripples, the apparatus comprising an acceleration sensor for detecting the moving acceleration of an elevation member, and a control circuit including a speed controller for generating an acceleration command to be issued to the elevation member in accordance with a speed deviation. An acceleration controller for generating a corrected propulsion command to be issued to the elevation member in accordance with an acceleration deviation between the acceleration command and the moving acceleration is provided and a electric power command generater for generating an electric power command to be issued to the inverter in accordance with the corrected propulsion command is also provided. In the described apparatus the moving acceleration is feedback-controlled by a control system having a high cut-off frequency so that an inverter electric command exhibiting excellent control responsiveness is generated.

11 Claims, 7 Drawing Sheets

27A

APPARATUS FOR CONTROLLING AN ELEVATOR TO REDUCE VIBRATIONS CREATED IN A LINEAR DRIVE MOTOR

This application is a continuation-on-part of application Ser. No. 07/988,848, filed Dec. 10, 1992 now abandoned.

BACKGROUND OF THE INVENTION

1. Field of the Invention

The present invention relates to an apparatus for controlling an elevator of a type which uses a linear induction motor to elevate/lower a car, and, more particularly, to an apparatus for controlling an elevator capable of providing enhanced comfort for passengers by compensating for propulsion changes and propulsion ripples.

2. Description of the Related Art

Hitherto, an apparatus for controlling an elevator has been known which has a linear induction motor composed of a primary coil (an armature), provided for a counterweight or a car, and a secondary conductor (conductor plate) provided in a shaftway to face the primary coil, the linear induction motor being able to generate propulsion with which the car is elevated/lowered.

In an apparatus of the aforesaid type, AC power is usually supplied to the linear induction motor from a variable voltage and variable frequency inverter thereof (hereinafter simply called an "inverter"). The inverter has a control circuit which feeds back the moving speed so as to subject it to a comparison with the commanded speed and controls the electric power to be supplied from the inverter to the linear induction motor in accordance with the obtained speed deviation.

FIG. 5 is a side elevational view which schematically illustrates a conventional apparatus for controlling an elevator disclosed in, for example, Japanese Patent Laid-Open No. 1-271381. FIG. 6 is a horizontal cross sectional view which illustrates a counterweight and a peripheral portion of a linear induction motor shown in FIG. 5.

Referring to FIGS. 5 and 6, reference numeral 1 represents a car, 2 represents a counterweight for balancing the weight of the car 1, and 3 represents a rope for suspending the car 1 and the counterweight 2 at extrimities thereof. The aforesaid elements 1, 2 and 3 constitute an elevation member disposed in the shaftway and moved together with the car 1.

Reference numeral 4 represents a sheave disposed in the upper portion of the shaftway and suspending the rope 3. Reference numeral 5 represents an L-shaped guide rail disposed along the shaftway, 6 represents a conductor plate held between a pair of the guide rails 5 and made of aluminum, and *6a* represents a joint of the two conductor plates 6. Reference numeral 7 represents a bracket for supporting the guide rail 5 and the conductor plate 6, and 8 represents a wall of a shaftway pit on which the guide rail and the conductor plate are disposed via the bracket 7.

The conductor plates 6 constitute secondary conductors of the linear induction motor respectively disposed on the two sides of the counterweight 2 in a direction in which the elevation member is elevated/lowered, that is, the conductor plates 6 are disposed along the shaftway.

Since the conductor plate 6 has a finite length, a plurality of the conductor plates 6 are joined up at joints *6a* so as to have a length which is the same as that of the passage in which the car 1 is elevated/lowered. The joints *6a* are disposed at proper joint clearances in order to prevent expansion and bending of the conductor plate 6 made of aluminum due to high temperature in summer.

Reference numeral 9 represents a primary coil of the linear induction motor, thatis, an armature of the same. A pair of the armatures 9 is disposed on each side of the counterweight 2 in such a manner that the two armatures 9 face and hold the conductor plate 6 therebetween so that magnetic flux generated at the time of application of the electric power interlinks the conductor plate 6.

Reference numeral 10 represents a speed sensor for detecting moving speed V of the elevation member, that is, the armature 10, the speed sensor 9 being composed of, for example, a disc, which is rotated while being brought into contact with the conduct or plate 6, and an encoder, which is operated in synchronization with the disc, and the like.

Referring to FIG. 5, reference numeral 11 represents a movable cable connected to the armatures 9 and the speed sensor 10 and suspended in the shaftway, 12 represents a control apparatus to which the moving speed V is supplied via the movable cable 11 and which includes an inverter to be described later, the inverter being arranged to supply AC power to the armatures 9.

FIG. 7 is a structural view which specifically illustrates the control apparatus shown in FIG. 5, in which reference numeral 20 represents a power source for supplying a three-phase alternating current, 21 represents a converter comprising a diode bridge which converts the alternating voltage supplied from the power source 20 into a direct current, and 22 represents a capacitor for smoothing the DC voltage transmitted from the converter 21. Reference numeral 23 represents the inverter comprising a transistor bridge which converts the DC voltage smoothed by the capacitor 22 into an alternating current having a variable voltage and a variable frequency, 24 represents a rectifier for detecting electric current Im to be supplied from the inverter 23 to the armature 9 of the linear induction motor, 25 represents a resistor connected in parallel to the capacitor 22 and consuming regenerated electric power supplied from the armature 9, and 26 represents a transistor switch which is switched on at the time of the regeneration of the electric power so as to cause the resistor 22 to consume the electric power.

Reference numeral 27 represents a control circuit for generating three-phase electric current command Is to be issued to the inverter 23 so as to cause the moving speed V detected and supplied from the speed sensor 10 to coincide with speed command Vs supplied from a speed command generator (omitted from illustration), and 28 represents a PWM circuit for generating PWM signal P with which the transistor disposed in the inverter 23 is turned on/off so as to cause the electric current Im supplied to the armature 9 and the electric current command Is to coincide with each other. FIG. 7 will also be used to describe control apparatuses 12A and 12B according to the present invention.

FIG. 8 is a block diagram which specifically illustrates the control circuit 27 shown in FIG. 7, in which reference numeral 31 represents a subtractor for subtracting the moving speed V from the speed command Vs so as to generate speed deviation $\Delta V$, 32 represents a speed controller for generating propulsion command Fs by compensating the gain and the phase of the speed deviation $\Delta V$, and 33 represents an electric-current command generator for generating the electric current command Is to be supplied to the armature 9 (the PWM circuit 28 in actual fact) in accordance with the propulsion command Fs and the moving speed V.

The electric-current command generator 33 serves as an electric power command generator for controlling the output electric power from the inverter 23, and the electric-current command Is may be replaced by a voltage command.

Then, the operation of the conventional apparatus for controlling an elevator will now be described with reference to FIGS. 5 to 8.

When the speed command $V_s$ has been generated by the speed command generator (omitted from illustration), the speed controller 32 disposed in the control circuit 27 generates the propulsion command Fs in accordance with the speed deviation ΔV, while the electric-current command generator 33 generates the electric-current command Is in accordance with the propulsion command Fs and the moving speed V.

Although the higher the cut-off frequency of the speed control system, which uses the speed controller 32, the better the responsiveness of controlling the elevator, the actual cut-off frequency is set to about several radian/second in order to prevent resonance with the mechanical system of the elevator including the rope 3.

The reason for this lies in that the frequency components larger than the several radian/second must be eliminated because the resonant frequency of the mechanical system of an elevator is usually about tens of radian/second (several Hz).

The PWM circuit 28 generates the PWM signal P in accordance with the electric-current command Is thus obtained, the PWM signal P being used to operate and control the inverter 23 in such a manner that the armature electric current Im coincides with the electric-current command Is.

As a result, eddy currents are generated in the conductor plates 6 due to the interlinked magnetic flux generated by the armatures 9, causing the armatures 9 to move along the conductor plates 6 due to the electromagnetic induction. Hence, the car .1 is elevated/lowered together with the armatures 9 along the rope 3 in accordance with the speed command Vs denoting the desired speed.

However, the presence of the gaps created by the joint clearances 6*a* between the conductor plates 6*a* disposed in the shaftway interrupts and discontinues the eddy currents flowing in the conductor plates 6. Therefore, the propulsion can be undesirably changed when the armatures 9 pass through the joint clearances 6*a*.

Moreover, because the armature 9 has a finite length in the, in which it is moved, peculiar propulsion ripples are generated at the time of the operation of the linear induction motor, causing the car 1 to be jolted and causing the passengers to feel uncomfortable.

The change of the propulsion, which takes place due to the presence of the joint clearances 6*a* between the conductor plates 6, is two times the slip frequency, while the propulsion ripple peculiar to the linear induction motor is two times the power source frequency, namely, the output frequency (several Hz) from the inverter 23.

Therefore, the frequency of the propulsion change becomes tens of radian/second. However, the propulsion change cannot be compensated because the cut-off frequency of the speed control system is several radian/second as described above.

The conventional apparatus for controlling an elevator, as described above, generates the propulsion command Fs by the speed control system which uses only the speed controller 32 and which has a low cut-off frequency of several radians per second, and controls the inverter 23 in accordance with the electric-current command Is generated in accordance with the propulsion command Fs.

Therefore, the responsiveness of the speed control has been unsatisfactory, and the propulsion change generated due to the presence of the joint clearances 6*a* and the propulsion ripples peculiar to the linear induction motor cannot be compensated, causing a problem to arise in that satisfactory comfort cannot be provided for the passengers.

SUMMARY OF THE INVENTION

Accordingly, an object of the present invention is to overcome the aforesaid problems by means of an apparatus for controlling an elevator which is capable of providing enhanced comfort for passengers by compensating for propulsion changes and propulsion ripples.

An apparatus for controlling an elevator according to the present invention comprises an acceleration sensor for detecting the moving acceleration of an elevation member, and a control circuit including a speed controller for generating an acceleration command to be issued to the elevation member in accordance with a speed deviation, an acceleration controller for generating a corrected propulsion command to be issued to the elevation member in accordance with an acceleration deviation between the acceleration command and the moving acceleration, and electric power command generating means for generating an electric power command to be issued to the inverter in accordance with the corrected propulsion command.

Another apparatus for controlling an elevator according to the present invention comprises a propulsion sensor for detecting the moving propulsion of an elevation member and a control circuit including a speed controller for generating a propulsion command in accordance with a speed deviation, a propulsion controller for generating a corrected propulsion command to be issued to the elevation member in accordance with a propulsion deviation between the propulsion command and the moving propulsion, and electric power command generating means for generating an electric power command to be issued to the inverter in accordance with the corrected propulsion command.

According to the present invention, the detected moving acceleration or the moving propulsion of the elevation member is directly feedback-controlled by using a control system having a high cut-off frequency so that an inverter electric power command revealing excellent control responsiveness is generated to compensate and reduce propulsion changes and propulsion ripples so as to provide enhanced comfort for passengers.

DESCRIPTION OF THE PREFERRED EMBODIMENTS

First Embodiment

Figure 1:
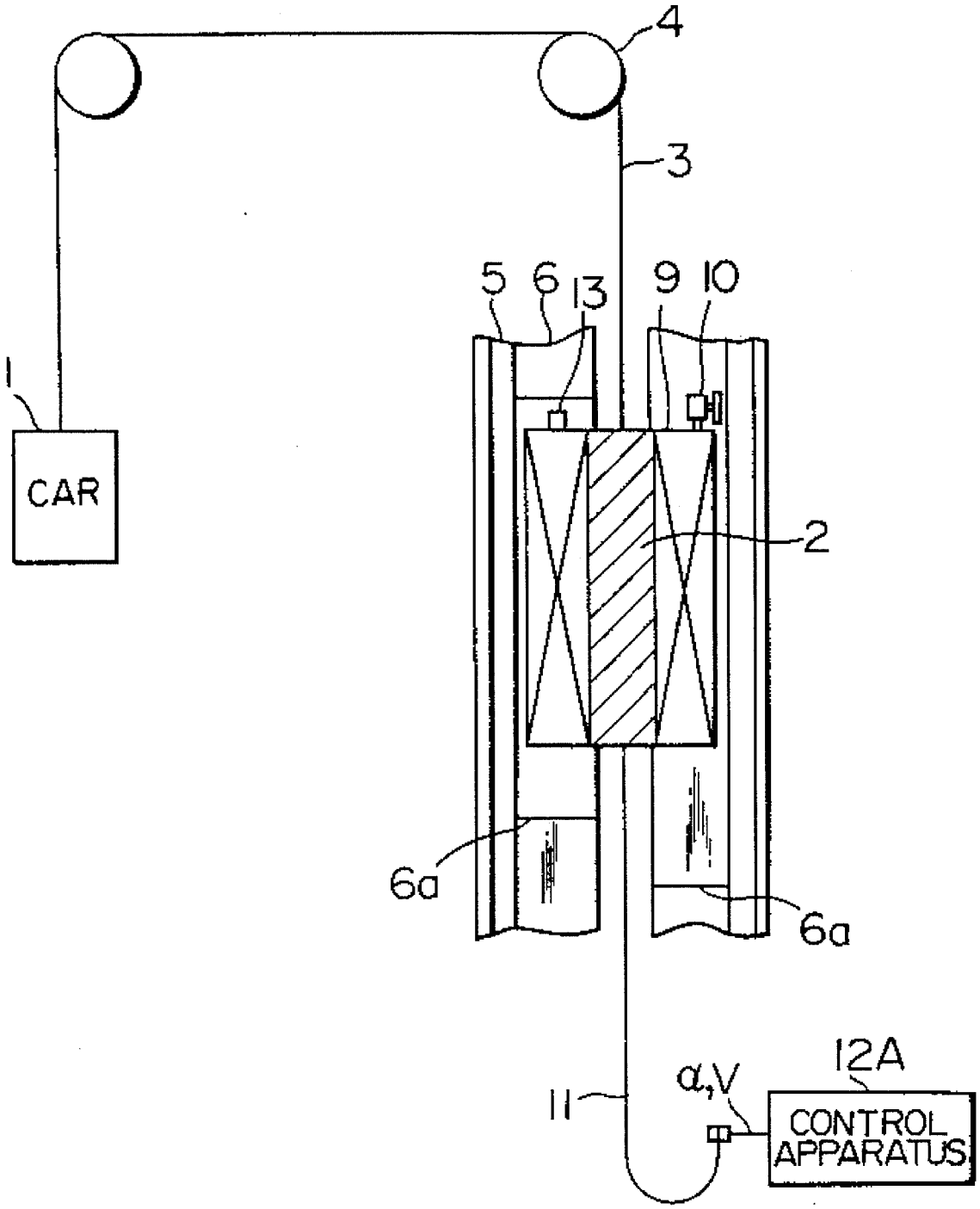
FIG. 1 is a side elevational view which schematically illustrates an embodiment of the present invention.

An embodiment of the present invention will now be described with reference to the drawings. FIG. 1 is a side elevational view which schematically illustrates the embodiment of the present invention, in which reference numerals 1 to 6 and 9 to 11 represent the same elements as those according to the aforesaid conventional apparatus.

Figure 6:
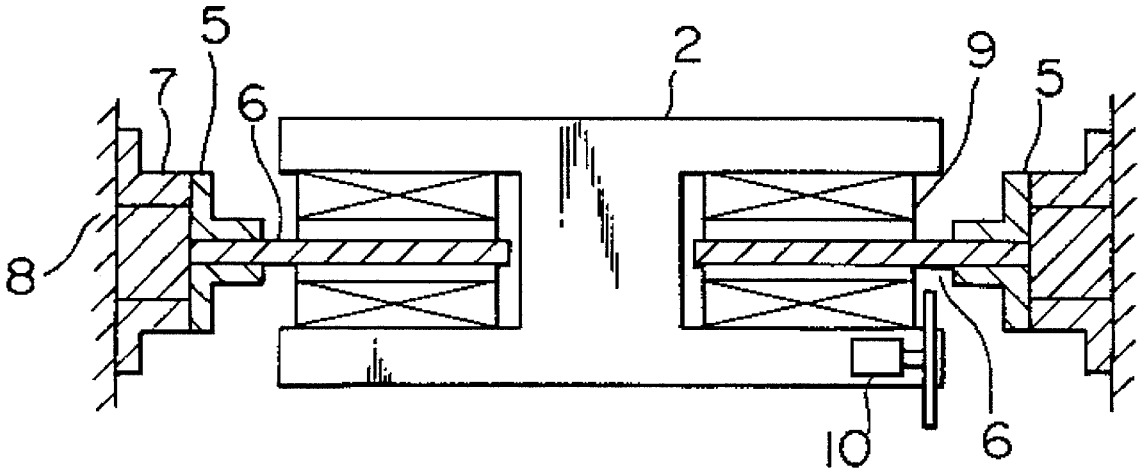
FIG. 6 is a horizontal cross sectional view which illustrates the structure of a portion of the apparatus depicted in FIG. 5 including a counterweight of an elevator.

The structure of the portion including the counterweight 2 is arranged as shown in FIG. 6. The specific structure of a control apparatus 12A is arranged to be the same as the control apparatus shown in FIG. 7 except for a portion of the control circuit 27.

Referring to FIG. 1, reference numeral 13 represents an acceleration sensor for detecting moving acceleration $\alpha$ of an elevation member, the acceleration sensor 13 being disposed at an arbitrary position (in the upper portion in the structure shown in FIG. 1) of the counterweight 2 (or the armatures 9) which constitutes the elevation member.

The moving acceleration $\alpha$ detected by the acceleration sensor 13 is, together with the moving speed V, supplied to the control apparatus 12A via the movable cable 11.

Figure 2:
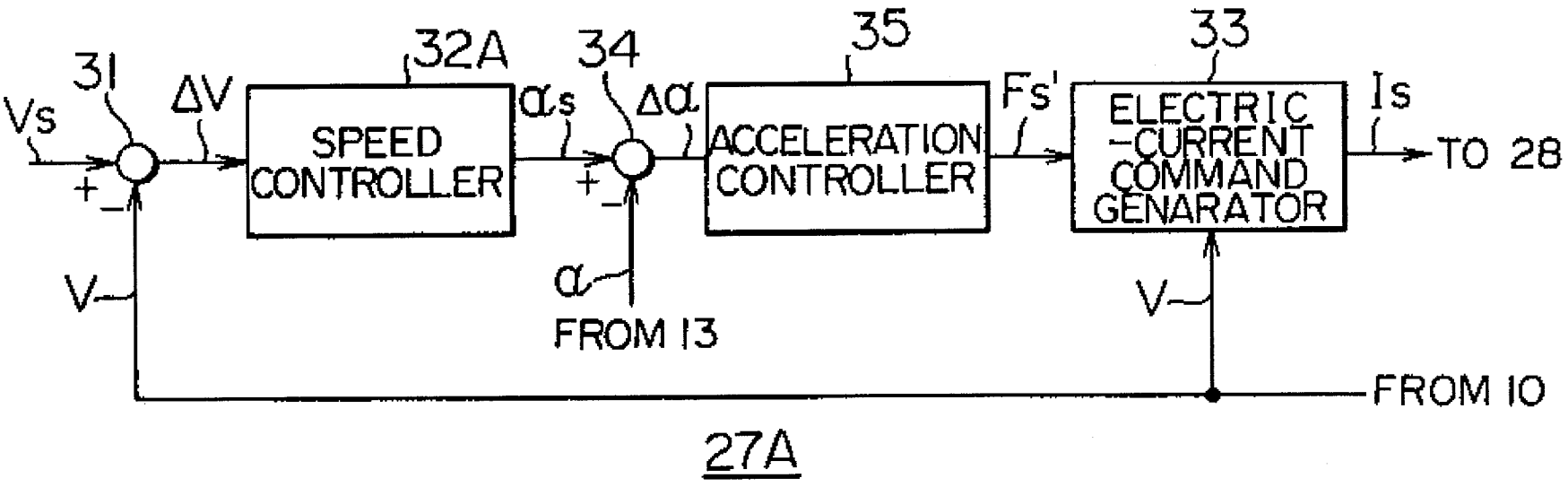
FIG. 2 is a block diagram which illustrates a control circuit according to the embodiment of the present invention depicted in FIG. 1.
Figure 7:
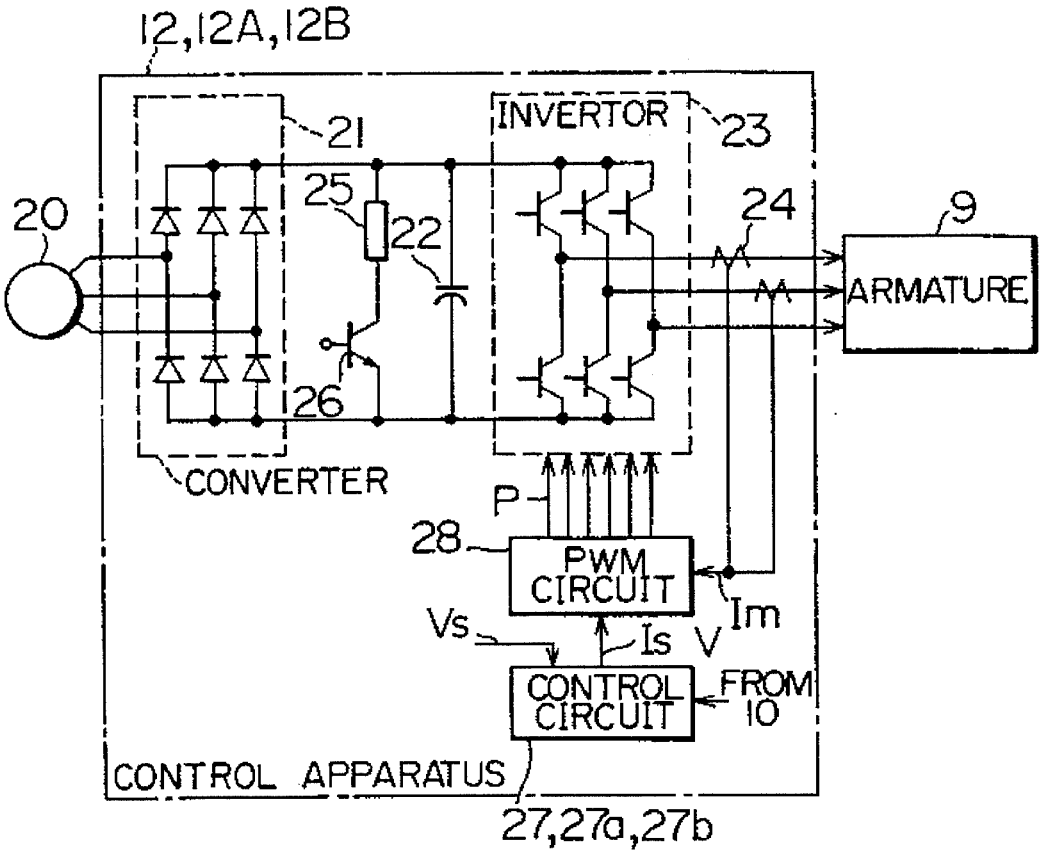
FIG. 7 is a structural view which illustrates an ordinary apparatus for controlling an elevator.
Figure 8:
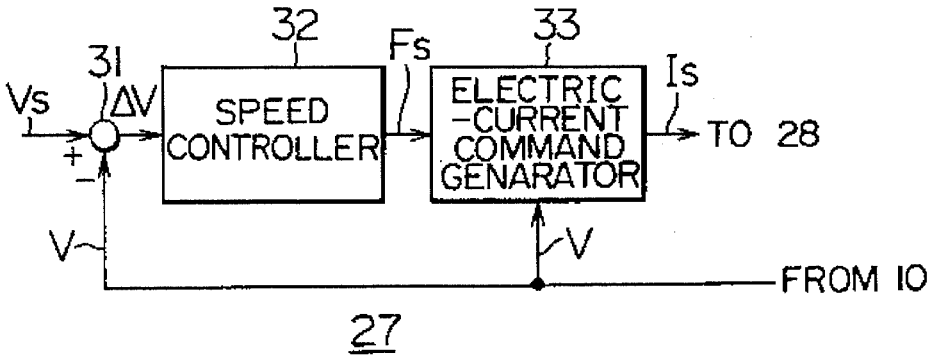
FIG. 8 PRIOR ART
FIG. 8 is a block diagram which illustrates the structure of a control circuit of a conventional apparatus for controlling an elevator.

FIG. 2 is a block diagram which specifically illustrates a control circuit 27A in the control apparatus 12A shown in FIG. 7, in which reference numeral 32A represents a speed controller for generating acceleration command $\alpha s$ to be issued to the elevation member by compensating the gain and the phase of the speed deviation $\Delta V$. The cut-off frequency for the speed controller 32A is several radian/seconds as in the speed controller 32 described earlier. Reference numeral 34 represents a subtractor for generating acceleration deviation $\Delta\alpha$ by subtracting the moving acceleration $\alpha$ from the acceleration command $\alpha s$, and 35 represents an acceleration controller for generating corrected propulsion command Fs' to be issued to the elevation member by compensating the gain and the phase of the acceleration deviation $\Delta\alpha$.

The cut-off frequency of the acceleration controller 35 is set to about hundreds of radian/second, and the corrected propulsion command Fs' generated by the acceleration controller 35 is supplied to an electric-power command generating means which issues the electric-power command to the inverter 23, namely, an electric-current command generator 33.

Then, the operation of the embodiment of the present invention will now be described with reference to FIGS. 1, 2 and 7. Since the basic control operation is performed similarly to that of the aforesaid conventional apparatus, its description is omitted here.

At the time of the elevating/lowering operation, the acceleration sensor 13 detects the moving acceleration $\alpha$ of the elevation member, namely, the counterweight 2, and then the acceleration sensor 13 supplies the detected moving acceleration $\alpha$ to the control circuit 27A in the control apparatus 12A.

Similarly to the speed controller 32, the speed controller 32A in the control circuit 27A shown fin FIG. 2 generates the acceleration command $\alpha s$ in accordance with the speed deviation $\Delta V$. The acceleration command $\alpha s$ can be obtained by substantially dividing the propulsion command Fs by the mass of the elevation member in accordance with equation of motion $F=m\alpha$.

The acceleration controller 35, in accordance with the acceleration deviation $\Delta\alpha$ between the acceleration command $\alpha s$ and the moving acceleration $\alpha$, generates the corrected propulsion command Fs' for balancing the acceleration deviation $\Delta\alpha$. In accordance with the corrected propulsion command Fs' and the moving speed V, the electric-current command generator 33 generates the electric-current command Is to be issued to the inverter 23. The electric-current command Is is supplied to the PWM circuit 28, the electric-current command Is being formed into the PWM signal P which controls the transistor disposed in the inverter 23. As a result, the inverter 23 generates AC electric power with which the armatures 9 are operated.

Although the cut-off frequency of the acceleration controller 35 is set to hundreds of radian/second as described above, it is desirable to avoid resonance between the control system and the elevator mechanical system. By combining the acceleration controller 35 and the speed controller 32 into a control system, the response gain of the control system is set at a low level. This is because the speed controller determines the response characteristic of the entire control system. Accordingly, the corrected propulsion command Fs' is, at this time, able to sufficiently correspond to the change of the propulsion of about tens of radian/second and unwanted resonance is avoided.

Therefore, a variety of propulsion changes including the propulsion ripples can be assuredly compensated and reduced due to the feedback control of the moving acceleration $\alpha$ so that enhanced comfort can be provided for the passengers.

Second Embodiment

Although the aforesaid embodiment is arranged in such a manner that the moving acceleration $\alpha$ is detected by the acceleration sensor 13, and the control circuit 27A feedback-controls the moving acceleration $\alpha$ for the purpose of generating the electric-current command Is, another arrangement may be employed in which the moving propulsion is detected by a propulsion sensor and the electric-current command Is is generated by feedback-controlling the moving propulsion.

Figure 3:
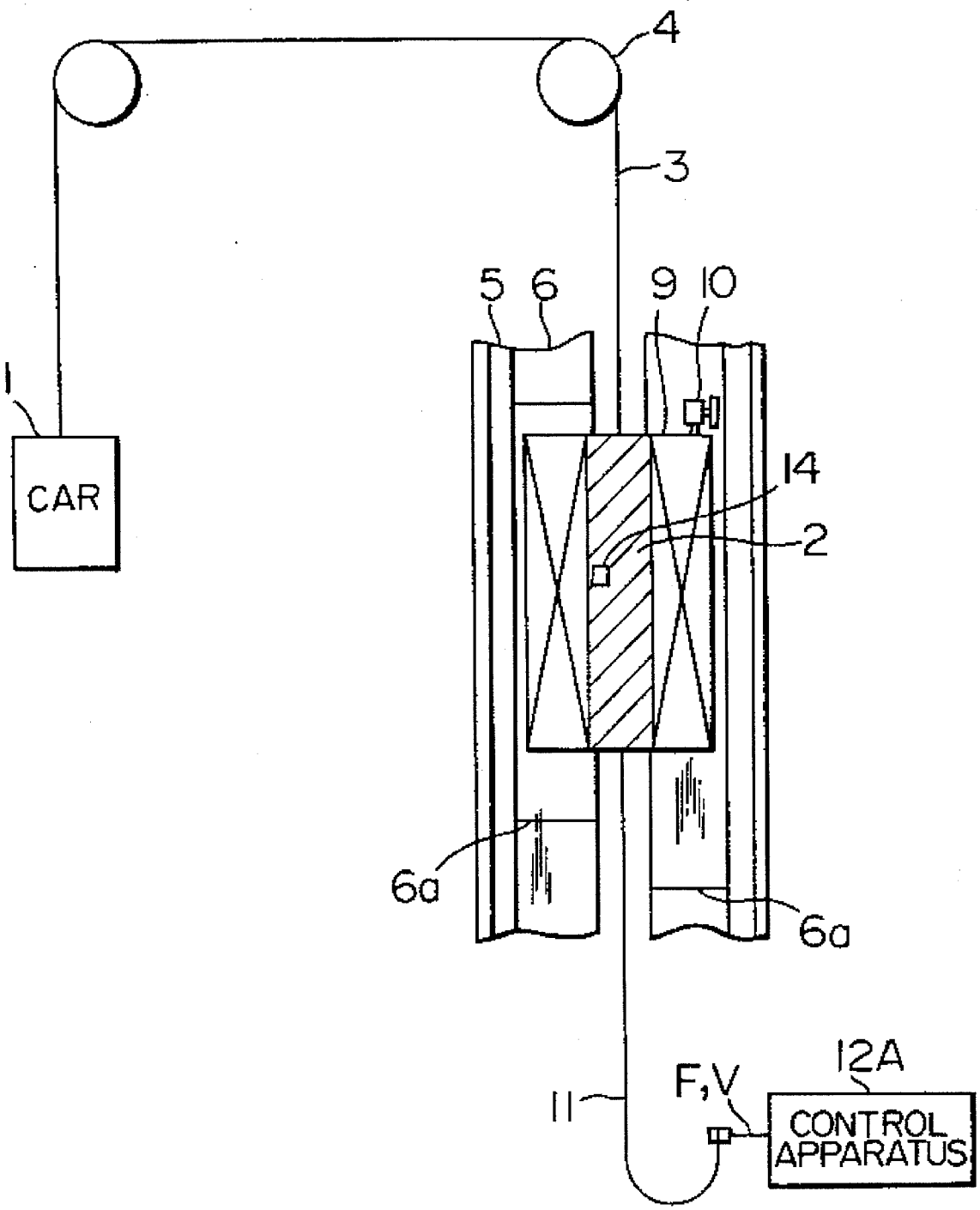
FIG. 3 is a side elevational view which schematically illustrates another embodiment of the present invention.

FIG. 3 is a side elevational view which schematically illustrates another embodiment of the present invention, in which moving propulsion F is used in the feedback control operation.

Reference numeral 14 represents a propulsion sensor for detecting the moving propulsion F of the elevation member, the propulsion sensor 14 being disposed on, for example, the side surface of the armature 9. Preferably, the propulsion sensor 14 is a strain gauge. It is necessary that the propulsion sensor 14 be disposed at a position, at which small strain generated at a position at which the armature 9 is fixed to the counterweight 2, can be measured.

The moving propulsion F detected by the propulsion sensor 14 is, together with the moving speed V, supplied to the control apparatus 12B via the movable cable 11.

Figure 4:
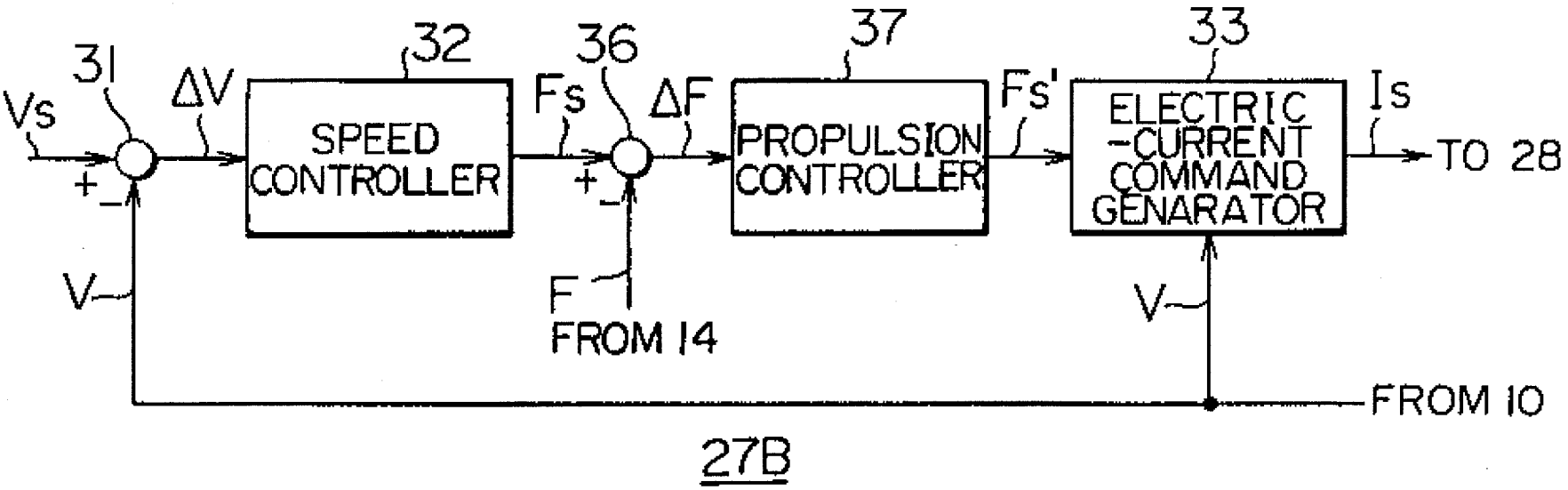
FIG. 4 is a block diagram which illustrates a control circuit according to the embodiment of the present invention depicted in FIG. 3.
Figure 5:
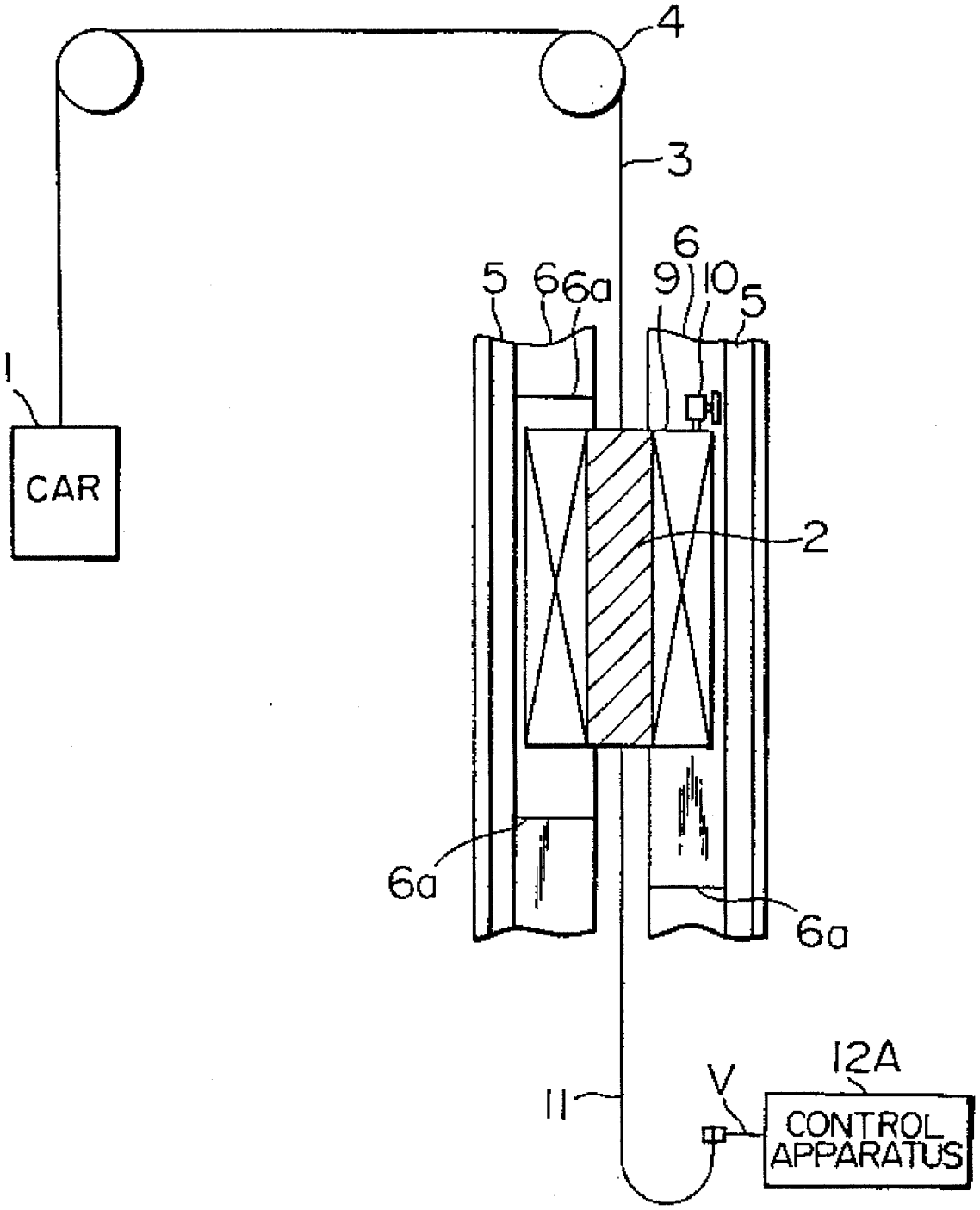
FIG. 5 PRIOR ART
FIG. 5 is a side elevational view which schematically illustrates a conventional apparatus for controlling an elevator.

FIG. 4 is a block diagram which specifically illustrate a control circuit 27B disposed in the control apparatus 12B, in which reference numeral 36 represents a subtractor for generating the propulsion deviation ΔF by calculating the difference between the propulsion command Fs supplied from the speed controller 32 and the moving propulsion F supplied from the propulsion sensor 14. Reference numeral 37 represents a propulsion controller for generating a final corrected-propulsion command Fs' by compensating the gain and the phase of the propulsion deviation ΔF.

The cut-off frequency of the propulsion controller 37 is set to about hundreds of radian/second, and the propulsion command Fs' is supplied to the electric current command generator 33. As in the first embodiment, the cut-off frequency of the speed controller remains low at several radians/second the speed controller determines the response characteristics of the entire control system.

Since the control responsiveness of the propulsion controller 37 can be improved also in the case where the control circuit 27B according to the second embodiment is used, the propulsion change can be assuredly compensated and reduced similarly to the first embodiment.

Although each of the aforesaid embodiments is arranged in such a manner that the electric-current command Is is used as the electric-power command generated by the control circuits 27A and 27B and to be issued to the inverter 23, a similar operation and effect can, of course, be obtained even if a voltage command is used.

As described above, the apparatus for controlling an elevator according to the present invention comprises an acceleration sensor for detecting the moving acceleration of the elevation member, and a control circuit including a speed controller for generating an acceleration command to be issued to the elevation member in accordance with a speed deviation, an acceleration controller for generating a corrected propulsion command to be issued to the elevation member in accordance with an acceleration deviation between the acceleration command and the moving acceleration, and electric power command generating means for generating an electric power command to be issued to the inverter in accordance with the corrected propulsion command, wherein the moving acceleration is feedback-controlled by a control system having a high cut-off frequency so that an inverter electric command exhibiting excellent control responsiveness is generated. Therefore, an effect can be obtained in that an apparatus for controlling an elevator which is capable of providing enhanced comfort to passengers can be obtained because the propulsion changes and the propulsion ripples are compensated and reduced.

Also the apparatus for controlling an elevator according to the present invention comprises a propulsion sensor for detecting the moving propulsion of an elevation member and a control circuit including a speed controller for generating a propulsion command in accordance with a speed deviation, a propulsion controller for generating a corrected propulsion command to be issued to the elevation member in accordance with a propulsion deviation between the propulsion command and the moving propulsion, and electric power command generating means for generating an electric power command to be issued to the inverter in accordance with the corrected propulsion command, wherein the moving propulsion is feedback-controlled by a control system having a high cut-off frequency so that an inverter electric power command revealing excellent control responsiveness is generated. Therefore, an effect can be obtained in that an apparatus for controlling an elevator which is capable of providing enhanced comfort to passengers can be obtained because the propulsion change and the propulsion ripples are compensated and reduced.

What is claimed is:

1. An apparatus for controlling an elevator which drives an elevation member including a car by a linear induction motor, comprising:

conductor plates of said linear induction motor which are disposed in a direction in which said elevation member is moved;

armatures of said linear induction motor which are disposed on said elevation member while facing said conductor plates;

an inverter for supplying alternating power to said armatures;

a speed sensor for detecting the moving speed of said elevation member;

an acceleration sensor for detecting the moving acceleration of said elevation member; and a control circuit for controlling said inverter in accordance with a speed command to be issued to said elevation member, said moving speed supplied from said speed sensor and said moving acceleration supplied from said acceleration sensor, wherein said control circuit includes a speed controller for generating an acceleration command to be issued to said elevation member in accordance with a speed deviation between a speed command to be issued to said elevation member and said moving speed, an acceleration controller for generating a corrected propulsion command to be issued to said elevation member in accordance with an acceleration deviation between an acceleration command and said moving acceleration;

electric power command generating means for generating an electric power command to be issued to said inverter in accordance with said corrected propulsion command and said moving speed, and said moving acceleration is feedback-controlled by said control circuit, and the acceleration controller includes a cut-off frequency sufficiently high to compensate for changes of propulsion and propulsion ripples.

2. An apparatus for controlling an elevator as claimed in claim 1 wherein said electric power command comprises an electric current command to be issued to said inverter.

3. An apparatus for controlling an elevator as claimed in claim 1 wherein said electric power command comprises a voltage command to be issued to said inverter.

4. An apparatus for controlling an elevator which drives an elevation member including a car by a linear induction motor, comprising:

conductor plates of said-linear induction motor which are disposed in a direction in which said elevation member is moved;

armatures of said linear induction motor which are disposed on said elevation member while facing said conductor plates;

an inverter for supplying alternating power to said armatures;

a speed sensor for detecting the moving speed of said elevation member;

a propulsion sensor for detecting a moving propulsion of said elevation member; and a control circuit for controlling said inverter in accordance with a speed command to be issued to said elevation member, said moving speed supplied from said speed sensor and said moving propulsion supplied from said propulsion sensor, wherein said control circuit includes a speed controller for generating a propulsion command to be issued to said elevation member in accordance with a speed deviation between said speed command to be issued to said elevation member and said moving speed, a propulsion controller for generating a corrected propulsion command to be issued to said elevation member in accordance with a propulsion deviation between a propulsion command and said moving propulsion;

electric power command generating means for generating an electric power command to be issued to said inverter in accordance with said corrected propulsion command, and said moving propulsion is feedback-controlled by said control circuit and said propulsion controller, and said propulsion controller includes a cutoff frequency sufficiently high to compensate for change of propulsion and propulsion ripples.

5. An apparatus for controlling an elevator as claimed in claim 4 wherein said propulsion sensor is composed of a strain gauge for measuring small strain at a position at which said armature is fixed to said elevation member.

6. An apparatus for controlling an elevator as claimed in claim 4 wherein said electric power command comprises an electric current command to be issued to said inverter.

7. An apparatus for controlling an elevator as claimed in claim 4 wherein said electric power command comprises a voltage command to be issued to said inverter.

8. An apparatus for controlling an elevator as claimed in claim 1 wherein the cut-off frequency of the acceleration controller is greater than 100 rad/sec.

9. An apparatus for controlling an elevator as claimed in claim 4 wherein the cut-off frequency of said propulsion controller is greater than 100 rad/sec.

10. An apparatus for controlling an elevator which drives an elevation member including a car by a linear induction motor, comprising:

a speed sensor for detecting a moving speed of the elevation member;

an acceleration sensor for detecting a moving acceleration of said elevation member;

a control circuit coupled to said speed sensor and said acceleration sensor, said control circuit including a speed controller for generating an acceleration command in accordance with a speed deviation between a speed command and the moving speed, an acceleration controller for generating a corrected propulsion command in accordance with an acceleration deviation between an acceleration command and the moving acceleration, and electric power command generating means for generating an electric power command in accordance with the corrected propulsion command and the moving speed, the speed controller having a first cut-off frequency and the acceleration controller having a second cut-off frequency where the second cut-off frequency is greater than the first cut-off frequency.

11. An apparatus for controlling an elevator as claimed in claim 10 further comprising means for generating an acceleration deviation signal by subtracting the moving acceleration from the acceleration command.

* * * * *